US007850103B2

(12) United States Patent
Eriksson et al.

(10) Patent No.: US 7,850,103 B2
(45) Date of Patent: Dec. 14, 2010

(54) ASSEMBLY AND METHOD FOR RESTRICTING SPINNING IN A GYRATORY CRUSHER

(75) Inventors: Bengt-Arne Eriksson, Svedala (SE); Johan Gunnarsson, Sövde (SE)

(73) Assignee: Sandvik Intellectual Property AB, Sandviken (SE)

( * ) Notice: Subject to any disclaimer, the term of this patent is extended or adjusted under 35 U.S.C. 154(b) by 48 days.

(21) Appl. No.: 12/457,041

(22) Filed: May 29, 2009

(65) Prior Publication Data

US 2009/0294559 A1 Dec. 3, 2009

(30) Foreign Application Priority Data

May 30, 2008 (SE) ..... 0801275

(51) Int. Cl.
*B02C 2/00* (2006.01)

(52) U.S. Cl. ..... 241/30; 241/34; 241/36; 241/207

(58) Field of Classification Search ..... 241/30, 241/34, 36, 207–216
See application file for complete search history.

(56) References Cited

U.S. PATENT DOCUMENTS 5,575,428 A * 11/1996 Cordonnier et al. ..... 241/30
2003/0102394 A1 6/2003 Martinez, Jr. et al.

* cited by examiner

*Primary Examiner*—Mark Rosenbaum
(74) *Attorney, Agent, or Firm*—Drinker Biddle & Reath LLP

(57) ABSTRACT

A crusher system includes a gyratory crusher, which has a crushing head, on which a first crushing shell is mounted; a frame, on which a second crushing shell is mounted; and a driving device, which is arranged to cause, by means of a rotating eccentric, the crushing head to execute a gyratory movement for crushing material. The crusher system includes a device for generating a signal that indicates the current tendency of the crushing head to spin; a device arranged to establish, based on the signal, a maximum allowable rotational speed for the eccentric; and a device arranged to adapt the rotational speed of the eccentric to a rotational speed that is lower than the maximum allowable rotational speed.

10 Claims, 4 Drawing Sheets

ASSEMBLY AND METHOD FOR RESTRICTING SPINNING IN A GYRATORY CRUSHER

CROSS-REFERENCE TO RELATED APPLICATIONS

This application claims priority under 35 U.S.C. §119 to Swedish patent application No. 0801275-9 filed May 30, 2008; the entire contents of which are hereby incorporated by reference.

TECHNICAL FIELD

The present disclosure relates to restricting spinning in a gyratory crusher, which comprises a crushing head, on which a first crushing shell is mounted; a frame, on which a second crushing shell is mounted, which second crushing shell defines together with the first crushing shell a crushing gap; and a driving device arranged to cause, by means of a rotating eccentric, the crushing head to execute a gyratory movement with a view to crushing material that is introduced in the crushing gap.

The present disclosure also concerns a crusher system comprising a gyratory crusher of the type stated above.

BACKGROUND ART

A gyratory crusher of the kind stated above can be used for crushing, for example, ore and stone material into smaller size.

US 2003/0102394 A1 discloses an assembly for restricting spinning in a gyratory crusher. The crusher is provided with an anti-reverse to counteract spinning as well as a friction-based torque-limiting slip clutch, which serves as an overload protection for the anti-reverse.

The tendency of an anti-reverse to break down leads to complex overall solutions, including different mechanisms to protect the anti-reverse as well as undesirable stoppages.

SUMMARY

A method of restricting spinning in a gyratory crusher and crusher system as disclosed can considerably reduce or completely eliminate the above drawbacks of previous methods and crusher systems.

A first embodiment includes a method of restricting spinning in a gyratory crusher which comprises a crushing head, on which a first crushing shell is mounted; a frame, on which a second crushing shell is mounted, which second crushing shell defines together with the first crushing shell a crushing gap; and a driving device which is arranged to cause, by means of a rotating eccentric, the crushing head to execute a gyratory movement with a view to crushing material that is introduced in the crushing gap, the method comprising the steps of a) reading a signal that indicates the current tendency of the crushing head to spin; b) establishing, based on the signal, a maximum allowable rotational speed for the eccentric; and c) adapting the rotational speed of the eccentric to a rotational speed that is lower than said maximum allowable rotational speed.

In the above method of controlling a gyratory crusher it is possible to restrict spinning without risking stoppages caused by a defective anti-reverse. In one embodiment, if, in step b), the signal satisfies a predetermined criterion, then the value of said maximum allowable rotational speed for the eccentric is set to a value that is lower than the current rotational speed of the eccentric. Such a predetermined criterion may be, for example, that the current tendency of the crushing head to spin should exceed a predetermined maximum tendency to spin.

According to a particular embodiment, the signal indicates whether a material to be crushed is present in the crushing gap. If no material to be crushed is present in the gap, it is likely that the crushing head will have an increased tendency to spin.

According to another particular embodiment, the signal indicates whether a material to be crushed is about to be fed into the crushing gap. If no material or only little material to be crushed is about to be fed, it is likely that before long the crushing head will show an increased tendency to spin.

According to another particular embodiment, the signal indicates the rotational speed of the crushing head. If the crushing head rotates faster than its normal rotational speed when rollingly engaged, it is likely that the crushing head will have an increased tendency to spin.

According to an additional embodiment, the signal indicates the direction of rotation of the crushing head. If the crushing head rotates in a direction opposite to the direction of the rotation that would be caused by a rolling engagement between the crushing head and said second crushing shell, it is likely that the crushing head will have an increased tendency to spin.

According to still another embodiment, the signal indicates the power consumption of the crusher system. If the power consumption of the crusher system is low, the friction of the relative movement of the crushing shells is low, which indicates that no material, or only little material, is present in the crushing gap. As a result the crushing head has an increased tendency to spin.

A further embodiment includes a crusher system comprising a gyratory crusher, which has a crushing head, on which a first crushing shell is mounted; a frame on which a second crushing shell is mounted, which second crushing shell defines together with the first crushing shell a crushing gap; a driving device which is arranged to cause, by means of a rotating eccentric, the crushing head to execute a gyratory movement with a view to crushing material that is introduced in the crushing gap, the crusher system further comprising a means for generating a signal that indicates the current tendency of the crushing head to spin; a means arranged to establish, based on the signal, a maximum allowable rotational speed for the eccentric; and a means arranged to adapt the rotational speed of the eccentric to a rotational speed that is lower than said maximum allowable rotational speed.

In one embodiment, if the signal indicating the current tendency of the crushing head to spin satisfies a predetermined criterion, the means arranged to establish a maximum allowable rotational speed is adapted to set the value of said maximum allowable rotational speed for the eccentric to a value that is lower than the current rotational speed of the eccentric. Thus, said means arranged to adapt the rotational speed of the eccentric will reduce the rotational speed of the eccentric when the crushing head has reached a certain tendency to spin.

According to another embodiment, the means for generating a signal is a sensor, which is arranged to indicate at least one of the following: the rotational speed of the crushing head; the direction of rotation of the crushing head; the power consumption of the crusher system; whether a material to be crushed is present in the crushing gap; or whether a material to be crushed is about to be fed into the crushing gap.

According to an additional embodiment, the means for generating a signal is a control means, which controls the feeding of material to be crushed to the crushing gap. For instance, a control signal intended for a feeding device for feeding material to be crushed to the crusher may be used to indicate the current tendency of the crushing head to spin.

The disclosed method and crusher system enables spinning restriction to be achieved with fewer mechanical components and/or in a more reliable manner. Further advantages and features will be apparent from the following description and the appended claims.

BRIEF DESCRIPTION OF THE DRAWINGS

The following detailed description can be read in connection with the accompanying drawings in which like numerals designate like elements and in which.

DETAILED DESCRIPTION

Figure 1:
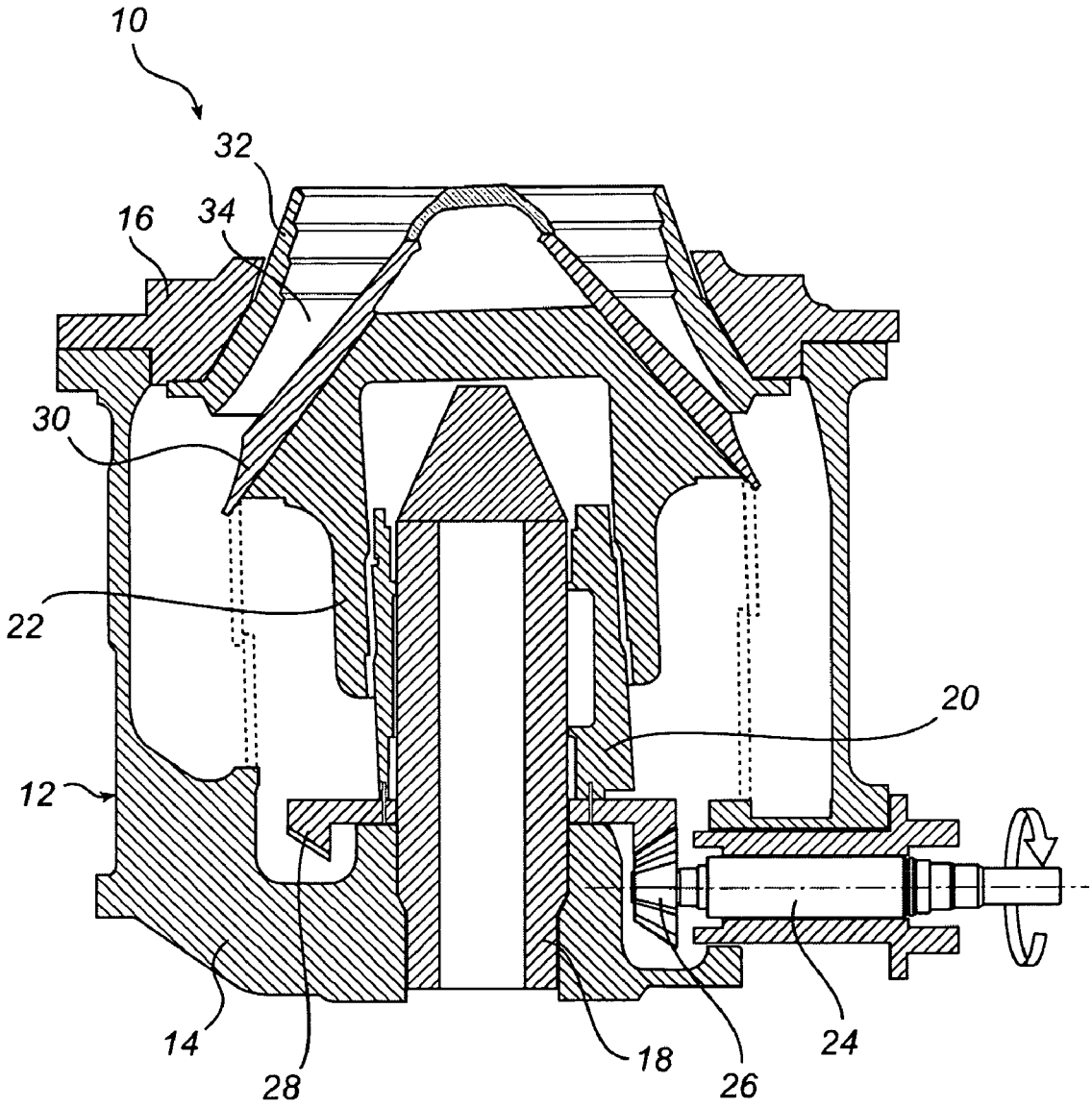
FIG. 1 is a schematic sectional view of a gyratory crusher.

FIG. 1 illustrates schematically a gyratory crusher 10, which has a frame 12 comprising a frame bottom part 14 and a frame top part 16. A vertical shaft 18 is fixedly attached to the frame bottom part 14 of the frame 12. An eccentric 20 is rotatably arranged about the vertical shaft 18. A crushing head 22 is rotatably arranged about the eccentric 20, and thus about the vertical shaft 18. A drive shaft 24 is arranged to cause, by means of a conical gear wheel 26 in mesh with a gear rim 28 coupled to the eccentric 20, the eccentric 20 to rotate about the vertical shaft 18. The outer periphery of the eccentric 20 is slightly inclined relative to the vertical plane, as is illustrated in FIG. 1 and previously known, as such, in the art. The inclination of the outer periphery of the eccentric 20 means that also the crushing head 22 will be slightly inclined relative to the vertical plane.

A first crushing shell 30 is fixedly mounted on the crushing head 22. A second crushing shell 32 is fixedly mounted on the frame top part 16. Between the two crushing shells 30, 32, a crushing gap 34 is formed, the width of which, in axial section, decreases in the downward direction, as illustrated in FIG. 1. As the drive shaft 24 rotates the eccentric 20 during operation of the crusher 10, the crushing head 22 will describe a gyratory movement. Material to be crushed is introduced in the crushing gap 34 and crushed between the first crushing shell 30 and the second crushing shell 32 due to the gyrating movement of the crushing head 22, during which movement the two crushing shells 30, 32 alternately approach one another and move away from one another. Moreover, the crushing head 22, and the first crushing shell 30 mounted thereon will, through the material to be crushed, be in rolling engagement with said second crushing shell 32. The rolling engagement causes the crushing head 22 to rotate slowly relatively to the frame 12 in a direction of rotation that is substantially opposite to the direction of rotation of the eccentric 20.

If no material to be crushed is present in the crushing gap 34, the crushing head 22 will not be in rolling engagement with said second crushing shell 32. Instead, the friction in the bearing between the eccentric 20 and the crushing head 22 will cause the crushing head 22 to rotate in the same direction and at substantially the same speed as the eccentric 20. The rotational speed of the eccentric 20 is much higher than the typical rotational speed of the crushing head 22 when rollingly engaged, also the crushing head 22 will reach a high rotational speed when no material is present in the crushing gap 34. This significant increase in the rotational speed of the crushing head 22 in one direction of rotation, which is opposite to the direction of rotation during the rolling engagement described above, is hereinafter referred to as "spinning". Accordingly, the crushing head 22 rotates slowly in a first direction of rotation, which is opposite to the direction of rotation of the eccentric 20, when a material is present in the crushing gap 34 and the crushing head 22 is rollingly engaged with the second crushing shell 32. When no material, or only little material, is present in the crushing gap 34, there is a risk, however, that the crushing head 22 quickly starts to rotate in a second direction of rotation, which is the same direction of rotation as that of the eccentric 20, which means that the crushing head 22 will spin. Spinning is undesirable and may cause increased wear to the crushing shells 30, 32. Spinning may also result in the supplied material to be crushed being thrown out of the feed opening of the crusher 10. To counteract spinning it has been suggested in prior art to connect an anti-reverse, for example of the type disclosed in US 2003/0102394 A1 referred to above, to a crushing head, so that the crushing head is able to rotate only in the direction associated with rolling engagement.

Figure 2:
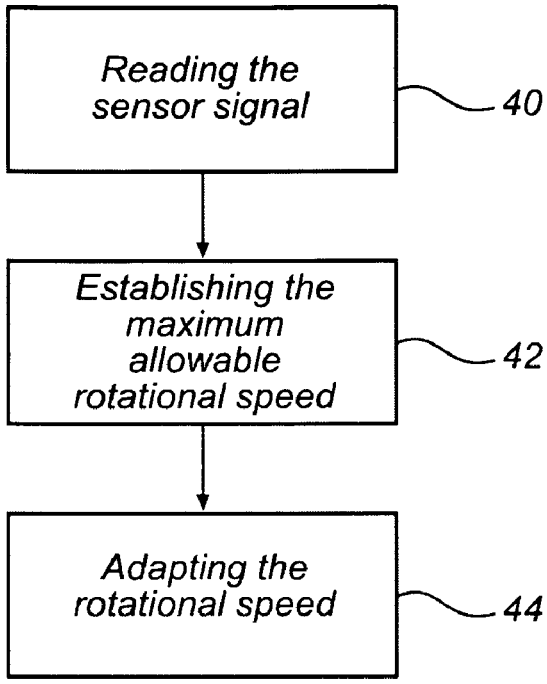
FIG. 2 is a flowchart illustrating a method of restricting spinning in a gyratory crusher.

FIG. 2 is a flowchart schematically illustrating a method according to an embodiment for restricting spinning in a gyratory crusher.

In step 40 a signal that indicates the current tendency of the crushing head to spin is read. Thus, this signal is an indication of whether the current operating conditions of the gyratory crusher are such that there is a risk that the crushing head will start to spin. The signal may be read, for example, from a sensor connected to an appropriate component of the crusher or to a component of those auxiliary systems, such as the material feed system, which are connected to the gyratory crusher; examples of a sensor of the latter type are described below with reference to FIG. 3. The signal may also be derived, for instance, by measuring the power output of a power source which drives the gyratory crusher, since variations in the load of the crusher typically cause variations in its power consumption. When the gyratory crusher is not subject to a load in the form of a material to be crushed its tendency to spin increases. Accordingly, also the power consumption of the power source is a signal that indicates the tendency of the crushing head to spin. Also devices that measure transmitted power or transmitted torque in the transmission between the power source and the crusher may provide a signal which indicates the power consumption of the crusher system and which therefore indicates the tendency of the crushing head to spin.

In step 42, based on the signal read in step 40, a maximum allowable rotational speed for the eccentric is established. This maximum allowable rotational speed for the eccentric is selected such that the crushing head will not start to spin under the current operating conditions of the gyratory crusher.

When the signal described above, which is read in step 40, indicates that material is being fed to the gyratory crusher, the tendency of the crushing head to spin will be low, since the crushing head is in rolling engagement with the second crushing shell, and thus a high maximum allowable rotational speed for the eccentric can be permitted. Under such operating conditions, the maximum allowable rotational speed for the eccentric may be set, for example, to 8 rps in step 42.

However, if the above-mentioned signal, which is read in step 40, indicates that no material is being fed to the gyratory crusher, the tendency of the crushing head to spin will be high. In this case, a maximum allowable rotational speed for the eccentric of 1 rps, for example, and usually more preferred of 0.35 rps, for example, may be established in step 42.

The maximum allowable rotational speed for the eccentric in step 42 may, for instance, be established in direct proportion to the current value of the signal, or by choosing between a small number of preset values which are to be applied when the tendency of the crushing head to spin passes predetermined limit values.

In step 44 the rotational speed of the eccentric is adapted to a rotational speed that is lower than the maximum allowable rotational speed established in step 42. The adjustment of the rotational speed of the eccentric in step 44 may occur, for example, in direct proportion to the current value of the signal, or by choosing between a small number of preset values which are to be applied when the tendency of the crushing head to spin passes predetermined limit values.

It will be appreciated that the rotational speed of the eccentric can be adjusted based on other parameters, which are not directly related to the tendency of the crushing head to spin, but which are related to the crushing process as such. Accordingly, such other parameters may be allowed to regulate the rotational speed of the eccentric, as long as the current rotational speed is lower than the maximum allowable rotational speed established in step 42. For example, when a maximum allowable rotational speed of 8 rps has been established according to the above, the current rotational speed of the eccentric may be set to 6 rps if this is the most appropriate solution for the current operation of the crusher in view of, for instance, the desired quality in terms of grain shape, size and/or quantity of the crushed material. At a later stage, when the tendency of the crushing head to spin has been found to be high, the current rotational speed of the eccentric must be reduced from 6 rps to a value below the maximum allowable rotational speed established with regard to such conditions, for example 0.35 rps. It is advantageous that the eccentric continues to rotate, even if the current rotational speed is lower than, for example, 0.35 rps, since crushing can be resumed much more rapidly when material is again fed to the gyratory crusher. For one thing the lubrication of bearings in the gyratory crusher will be upheld also when the rotational speed has been reduced, for example, to a value slightly below 0.35 rps.

The rotational speed does not have to be regulated by setting absolute speeds; it is enough to specify the sign of the desired change of the maximum rotational speed. For example, when the tendency of the crushing head to spin exceeds a certain limit value, a control unit may determine that the maximum allowable rotational speed for the eccentric is lower than the current rotational speed of the eccentric. And so the control unit can make sure that the rotational speed of the eccentric is lowered.

Steps 40-44 are performed automatically by a control unit connected to the gyratory crusher, i.e. without the need for an operator to intervene.

Figure 3:
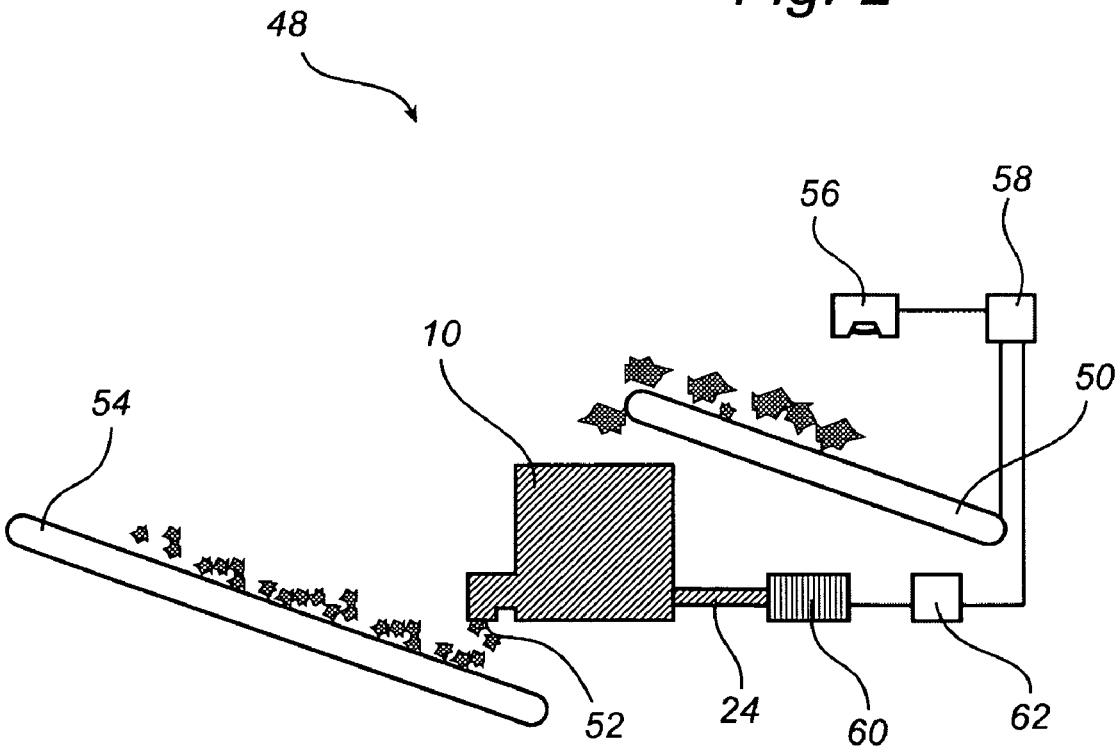
FIG. 3 illustrates schematically a crusher system arranged to restrict spinning.

FIG. 3 shows a crusher system 48, which comprises the gyratory crusher 10 described with reference to FIG. 1. The crusher system 48 further comprises a number of auxiliary systems, which are adapted to feed material to the gyratory crusher 10 and to collect the crushed material. Accordingly, the crusher system 48 comprises a first conveyor belt 50, which is arranged to feed material to be crushed to the crusher 10. The crushed material leaves the crusher 10 through a discharge opening 52, and is transported away from the crusher 10 by means of a second conveyor belt 54. At the first conveyor belt 50 a detecting means is provided in the form of an optical sensor 56 arranged for optical detection of material to be crushed. The sensor 56 signals to a control unit 58 whether or not material to be crushed passes on the conveyor belt 50. Alternatively, the sensor 56 may also signal to the control unit 58 the amount of material that passes on the conveyor belt 50. Moreover, it is conceivable to arrange, as an alternative to the sensor 56, or in combination with the same, a sensor for detecting the presence of material that has been crushed in the crusher 10. Such a second sensor may, for example, be arranged at the discharge opening 52 or at the second conveyor belt 54.

The crusher 10 is driven by an AC-type electric motor 60 via the drive shaft 24. The rotational speed of the crusher's 10 eccentric 20, as described above with reference to FIG. 1, is regulated by means of a frequency converter 62, which is coupled to an AC voltage source (not shown in FIG. 3) and connected to and controlled by the control unit 58. The control unit 58 is arranged to instruct the frequency converter 62 to lower the frequency of the driving voltage for the electric motor 60 if the tendency of the crushing head 22 to spin increases. Thus, the control unit 58 controls the rotational speed of the eccentric 20 via the frequency converter 62.

The optical sensor 56 provides the control unit 58 with information about how much material to be crushed is being passed along the conveyor belt 50. When the feeding of material to be crushed along the conveyor belt 50 decreases significantly, or is discontinued altogether, the control unit 58 decides that the tendency of the crushing head 22 to spin is about to increase. The control unit 58 establishes a maximum allowable rotational speed for the eccentric based on the information from the sensor 56 and, if the current rotational speed of the eccentric exceeds the thus established maximum allowable rotational speed, signals to the frequency converter 62 to lower the frequency of the driving voltage for the electric motor 60. As a result the rotational speed of the eccentric 20 is lowered and the tendency of the crushing head 22 to spin is reduced.

When material to be crushed again passes the optical sensor 56 in such a quantity as to provide an adequate rolling engagement between the crushing head 22 and the second crushing shell 32, the control unit 58 decides that the tendency of the crushing head 22 to spin is about to decrease. The control unit 58 then establishes a new, higher maximum allowable rotational speed for the eccentric 20 and signals to the frequency converter 62 to increase the rotational speed of the eccentric 20.

According to an alternative embodiment, the control unit 58 controls the conveyor belt 50 which feeds material to be crushed in the crushing gap 34 shown in FIG. 1. In this case, the control unit 58 may itself provide the signal indicating the tendency of the crushing head 22 to spin, based on whether or not the conveyor belt 50 has been instructed to feed material, and may on the basis thereof establish an appropriate maximum allowable rotational speed for the eccentric 20.

Figure 4:
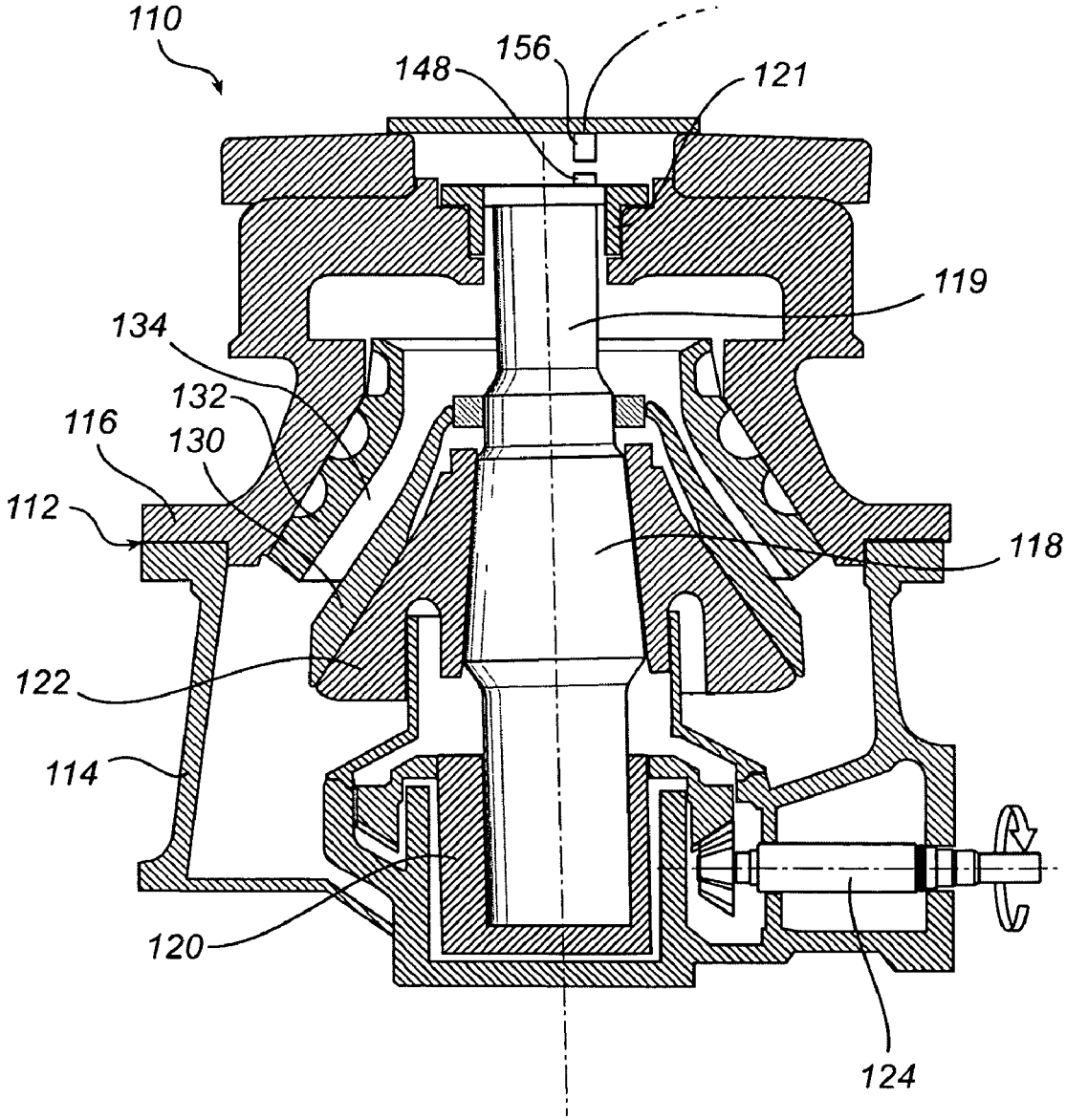
FIG. 4 is a schematic sectional view of an alternative embodiment of a gyratory crusher.

FIG. 4 illustrates schematically a gyratory crusher 110 according to an alternative embodiment. The gyratory crusher 110 has a frame 112 comprising a frame bottom part 114 and a frame top part 116. A vertical shaft 118 is rotatably mounted in an eccentric 120. A crushing head 122 is fixedly mounted about the vertical shaft 118. A diesel motor (not shown) is arranged to rotate the eccentric 120 by means of a drive shaft 124. The vertical shaft 118 is journalled at its upper end 119 in a top bearing 121 in the frame top part 116.

A first crushing shell 130 is fixedly mounted on the crushing head 122. A second crushing shell 132 is fixedly mounted on the frame top part 116. A crushing gap 134 is formed between the two crushing shells 130, 132. As the drive shaft 124 rotates the eccentric 120 during operation of the crusher 110, the crushing head 122, and the first crushing shell 130 mounted thereon, will, through the material to be crushed, be in rolling engagement with said second crushing shell 132. The rolling engagement causes the crushing head 122 to rotate slowly, in a direction of rotation substantially opposite to the direction of rotation of the eccentric 120, in a manner similar to that described above with reference to FIG. 1.

A permanent magnet 148 is attached near the periphery of the upper end surface of the shaft 118 and is thus arranged to rotate with the shaft 118. A detecting means in the form of a sensor 156, which may be, for example, of the Hall-type known per se, is attached to the frame top part 116 and arranged to produce an electrical signal when the magnet 148 passes. The sensor 156 thus constitutes, in collaboration with the magnet 148, a revolution counter, which enables measuring of the rotational speed of the shaft 118 relative to the frame 112.

Figure 5:
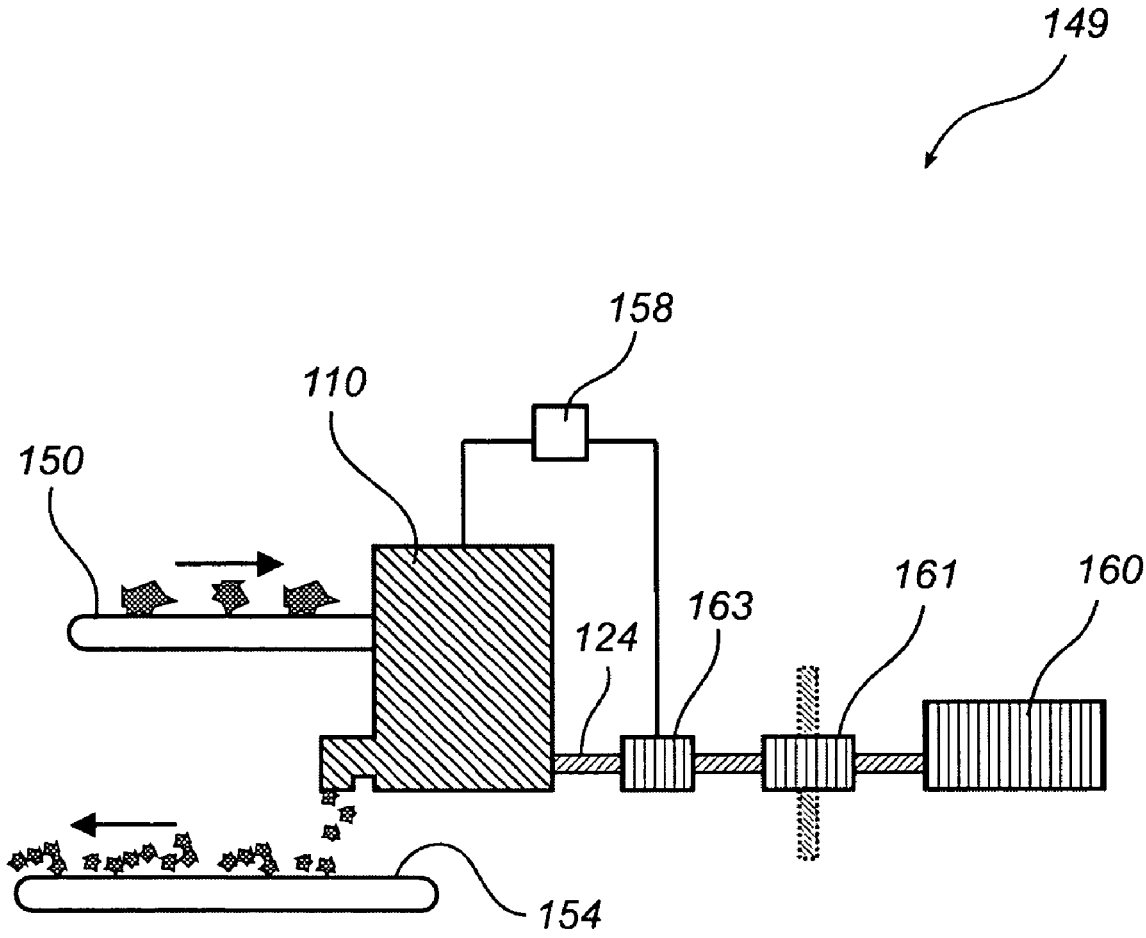
FIG. 5 illustrates schematically an alternative embodiment of a crusher system arranged to restrict spinning.

FIG. 5 shows a crusher system 149, which comprises the gyratory crusher 110 described above with reference to FIG. 4. Material to be crushed is fed to the crusher 110 by means of a conveyor belt 150. The crushed material is transported away from the crusher 110 on a conveyor belt 154.

The crusher system 149 has a driving source in the form of a diesel motor 160. The crusher's 110 drive shaft 124 is driven by the diesel motor 160 via a gear unit 161 and a hydraulic slip clutch 163. The gear unit 161 is arranged to distribute power from the motor 160 to the crusher 110 and to a number of other components (not shown) of the system 149.

The hydraulic slip clutch 163 enables the transmission between the gear unit 161 and the drive shaft 124 to be varied in a controllable manner. This means that the number of revolutions of the drive shaft 124, and thus of the eccentric 120, see FIG. 4, can be regulated.

The crusher's 110 sensor 156, see FIG. 4, is connected to a control unit 158, which is arranged to control the degree of meshing, and thereby the transmission, of the clutch 163. When the signal from the sensor 156 indicates to the control unit 158 that the number of revolutions of the shaft 118, see FIG. 4, increases, i.e. that the tendency of the crushing head 122 to spin is about to increase, the control unit 158 is arranged to control the slip clutch 163 to reduce the transmission of torque between the gear unit 161 and the drive shaft 124. As a result, the tendency of the crushing head 122 to spin is reduced. Similarly, the transmission of torque can be increased again when the crushing head 122 shows a reduced tendency to spin.

In the above example, the rotational speed of the eccentric 120 is regulated based on the rotational speed of the shaft 118. It is also conceivable, of course, to base the regulation on the direction of rotation of the shaft 118, for example by automatically reducing the number of revolutions of the eccentric 120 to a predetermined anti-spin rps if the direction of rotation of the shaft 118 is opposite to the direction of rotation associated with rolling engagement.

As illustrated in the above examples, the control unit and the detecting means need not be comprised in the gyratory crusher as such, but may form part of a larger crusher system. Thus, by crusher system is also meant equipment that cooperates with the crusher, such as driving sources, conveyor belts, control and monitoring equipment etc.

By current tendency of the crushing head to spin is meant both its tendency to immediately start spinning or continue spinning depending on the prevailing operating conditions and its expected future tendency to start spinning depending on the prevailing operating conditions.

There are many different ways of reading a signal that indicates the current tendency of the crushing head to spin. Examples of such signals are control signals controlling the feeding to the crusher of material to be crushed, for instance on conveyor belts, by means of screw conveyors or through controllable doors. The various signals indicating that material to be crushed is entering the crusher, for example the signal from a weigher arranged at a conveyor belt which feeds material to the crusher, or the signal from a magnetic sensor which detects a passing magnetic material such as iron ore, all indicate the current tendency of the crushing head to spin. Signals indicating that material to be crushed is present in the crusher's crushing gap, for example signals which indicate the load on the driving source of the crusher, or which indicate the working height of the crushing head in a crusher which, in a manner known to the skilled person, has a vertically adjustable mechanism for the crushing head, may also be used. All such signals fall within the scope of the appended claims. Moreover, a signal may be used which is a balanced combination of several factors, for example a combination of whether material to be crushed is present in the crushing gap and the current rotational direction of the crushing head.

It has been described above how the disclosed method and crusher system can be applied to crushers driven by electric motors and diesel motors. It will be appreciated that the disclosed method and crusher system can also be applied to crushers driven by hydraulic motors. In a crusher driven by a hydraulic motor the number of revolutions of the eccentric is suitably adapted, in step 44 shown in FIG. 2, by regulating the hydraulic oil flow to the hydraulic motor, so that the flow that provides the currently desired rotational speed of the eccentric is obtained.

With reference to FIG. 5, a hydraulic slip clutch 163 is described in combination with a diesel motor. It will be appreciated that also electric motors and hydraulic motors can be combined with a hydraulic slip clutch.

The disclosed method and crusher system can be applied to different types of gyratory crushers, including the type of gyratory crusher which is illustrated in FIG. 1 and which is without a top bearing and the type of gyratory crusher which is illustrated in FIG. 4 and which is provided with a top bearing. The disclosed method and crusher system may also be applied to other types of gyratory crushers.

Although described in connection with preferred embodiments thereof, it will be appreciated by those skilled in the art that additions, deletions, modifications, and substitutions not specifically described may be made without departure from the spirit and scope of the invention as defined in the appended claims.

What is claimed is:

1. A method of restricting spinning in a gyratory crusher, which comprises a crushing head on which a first crushing shell is mounted; a frame on which a second crushing shell is mounted, which second crushing shell defines together with the first crushing shell a crushing gap; and a driving device, which is arranged to cause, by means of a rotating eccentric, the crushing head to execute a gyratory movement with a view to crushing material that is introduced in the crushing gap, the method comprising the steps of:

a) reading a signal that indicates the current tendency of the crushing head to spin;

b) establishing, based on the signal, a maximum allowable rotational speed for the eccentric; and c) adapting a rotational speed of the eccentric to a rotational speed that is lower than said maximum allowable rotational speed.

2. A method according to claim 1, wherein in step b), if the signal satisfies a predetermined criterion relating to the current tendency of the crushing head to spin, the value of said maximum allowable rotational speed for the eccentric is set to a value that is lower than the current rotational speed of the eccentric.

3. A method according to claim 1, wherein the signal indicates whether a material to be crushed is present in the crushing gap.

4. A method according to claim 1, wherein the signal indicates whether a material to be crushed is about to be fed into the crushing gap.

5. A method according to claim 1, wherein the signal indicates a rotational speed of the crushing head, a direction of rotation of the crushing head, or a combination thereof.

6. A method according to claim 1, wherein the signal indicates an amount of power consumed by the crusher system.

7. A crusher system comprising a gyratory crusher, which has a crushing head, on which a first crushing shell is mounted; a frame, on which a second crushing shell is mounted, which second crushing shell defines together with the first crushing shell a crushing gap; and a driving device, which is arranged to cause, by means of a rotating eccentric, the crushing head to execute a gyratory movement for crushing material that is introduced in the crushing gap, wherein the crusher system comprises:

a means for generating a signal that indicates a current tendency of the crushing head to spin;

a means arranged to establish, based on the signal, a maximum allowable rotational speed for the eccentric; and a means arranged to adapt a rotational speed of the eccentric to a rotational speed that is lower than said maximum allowable rotational speed.

8. A crusher system according to claim 7, wherein, if the signal indicating the current tendency of the crushing head to spin satisfies a predetermined criterion, the means arranged to establish the maximum allowable rotational speed of the eccentric is adapted to set a value of said maximum allowable rotational speed for the eccentric to a value that is lower than the current rotational speed of the eccentric.

9. A crusher system according to claim 7, wherein the means for generating a signal is a sensor, which is arranged to indicate at least one of the group consisting of a rotational speed of the crushing head; a direction of rotation of the crushing head; an amount of power consumed by the crusher system; whether a material to be crushed is present in the crushing gap; and whether a material to be crushed is about to be fed into the crushing gap.

10. A crusher system according to claim 7, wherein the means for generating a signal is a control means, which controls the feeding of material to be crushed to the crushing gap.

* * * * *